US007270725B2

(12) United States Patent
Lindstrom et al.

(10) Patent No.: US 7,270,725 B2
(45) Date of Patent: Sep. 18, 2007

(54) PRETREATMENT OF CHIPS WITH WHITE LIQUOR PRIOR TO A TREATMENT WITH BLACK LIQUOR

(75) Inventors: Mikael Lindstrom, Stockholm (SE); Vidar Snekkenes, Karlstad (SE)

(73) Assignee: Metso Fiber Karlstad AB, Karlstad (SE)

( * ) Notice: Subject to any disclaimer, the term of this patent is extended or adjusted under 35 U.S.C. 154(b) by 120 days.

(21) Appl. No.: 10/497,346

(22) PCT Filed: Dec. 13, 2002

(86) PCT No.: PCT/SE02/02317

§ 371 (c)(1),
(2), (4) Date: Jun. 1, 2004

(87) PCT Pub. No.: WO03/057979

PCT Pub. Date: Jul. 17, 2003

(65) Prior Publication Data

US 2005/0103454 A1 May 19, 2005

(30) Foreign Application Priority Data

Dec. 14, 2001 (SE) ..... 0104247

(51) Int. Cl.

| | |
|---|---|
| ***D21C 3/22*** | (2006.01) |
| ***D21C 3/24*** | (2006.01) |
| ***D21C 1/00*** | (2006.01) |
| ***D21C 1/06*** | (2006.01) |

(52) U.S. Cl. ..... 162/19; 162/29; 162/37; 162/41; 162/52; 162/68

(58) Field of Classification Search ..... 162/19, 162/37, 39, 40–41, 47, 29, 52, 68
See application file for complete search history.

(56) References Cited

U.S. PATENT DOCUMENTS 2,175,154 A * 10/1939 Merrill ..... 162/44
3,303,088 A * 2/1967 Gessner ..... 162/19

(Continued)

FOREIGN PATENT DOCUMENTS

JP 2005514535 W * 5/2005

(Continued)

*Primary Examiner*—José A. Fortuna
(74) *Attorney, Agent, or Firm*—Rolf Fasth; Fasth Law Offices

(57) ABSTRACT

The method is for the manufacture of cooked cellulose pulp in which the starting material, preferably chips, undergoes a successive increase in temperature towards cooking temperature. This is done while the chips are first treated in a pre-treatment zone in which the main part, greater than 50%, of fresh white liquor necessary for the cooking stage is added, after which this alkali-rich treatment fluid is withdrawn and replaced to a major extent by black liquor. The alkali-rich treatment fluid that has been withdrawn after the pre-treatment stage is then added to the cooking stage, which is why the addition of fresh white liquor to the cooking stage is reduced to an equivalent amount. Maximal yield-enhancing effect is obtained using poly-sulphide-rich white liquor during the pre-treatment at a temperature in the interval 60±40° C. and retention time in the interval 2-60 minutes, preferably 2-10 minutes.

12 Claims, 3 Drawing Sheets

U.S. PATENT DOCUMENTS

| | | | | |
|---|---|---|---|---|
| 5,080,755 | A * | 1/1992 | Backlund | 162/19 |
| 5,089,086 | A * | 2/1992 | Silander | 162/19 |
| 5,635,026 | A * | 6/1997 | Kettunen et al. | 162/19 |
| 5,736,006 | A * | 4/1998 | Prough | 162/52 |
| 6,280,567 | B1 * | 8/2001 | Gustavsson et al. | 162/14 |
| 6,533,896 | B1 * | 3/2003 | Tikka et al. | 162/19 |
| 2004/0089430 | A1 * | 5/2004 | Fant et al. | 162/19 |
| 2005/0103454 | A1 * | 5/2005 | Lindstrom et al. | 162/19 |

FOREIGN PATENT DOCUMENTS

| | | | |
|---|---|---|---|
| WO | WO 9615313 | A1 * | 5/1996 |
| WO | WO 2003057979 | A1 * | 7/2003 |

* cited by examiner

PRETREATMENT OF CHIPS WITH WHITE LIQUOR PRIOR TO A TREATMENT WITH BLACK LIQUOR

PRIOR APPLICATION

This application is a U.S. national phase application based on International Application No. PCT/SE02/02317, filed 13 Dec. 2002, claiming priority from Swedish Patent Application No. 0104247-2, filed 14 Dec. 2001.

The present invention concerns a method for the production of cellulose pulp according to the introduction of claim 1.

THE PRIOR ART

In older conventional continuous digesters, all alkali was essentially added at the inlet or at the top of the digester during uninterrupted and established operation. A certain addition of alkali also took place in the feed system, the main purpose of which was to lubricate the high-pressure tap and, to a certain extent, to adjust the level of alkali. In addition, a certain addition may also have taken place at the bottom of the digester, but in this case principally in order to dissolve temporary blockages or in order to initiate the process during start-up.

Extremely high concentrations of alkali at a level of 60 grams NaOH per litre of cooking fluid, or higher, were obtained at the top of the digester, and relatively low levels of residual alkali were obtained in the extracted expended cooking fluid. The white liquor charge was subsequently divided further so that more white liquor was added during impregnation, in particular for two-vessel cooking systems, in order to reduce the high concentrations of alkali at the beginning of the cooking stage.

Cooking technology has since then undergone development, the purpose of which has been to achieve increased yield and improved pulp quality. An important precondition was the requirement to limit high levels of alkali, which could have a detrimental influence on the quality of the pulp, and instead focus at achieving a constant level of alkali during the cooking stage. ITC (IsoThermal Cooking) technology is one method of improving the quality of the pulp. In this case, the cooking temperature is held at a constant level during the complete cooking stage, preferably during a longer part of the retention time in the digester than that used in known technology, and in which alkali is added at the end of the cooking stage. The cooking temperature could in this way be reduced to a lower level, and the division of the addition of alkali to the cooking stage ensured lower levels of alkali at the beginning of the cooking stage, a result that was advantageous for the quality of the pulp.

The initial level of alkali during the cooking stage has been reduced in the MCC (Modified Continuous Cooking) technology, and an alkali level of approximately 23 g NaOH/l is typically established in the transfer to the digester, after which a cooking zone with a level that typically lies around 15 g NaOH/l is established, with a final withdrawal from the digester at a level of approximately 10 g NaOH/l.

Addition of alkali in all of these concepts has occurred early during the cooking stage, or early during impregnation, after which the established cooking fluid has successively received the addition of greater or lesser amounts of alkali.

The MCC technology was developed during the 1980s and involves the division of alkali charges. The main part, approximately 75%-80%, was normally added in the concurrent zone, 45%-70% of which was added to the impregnation stage, and 10%-35% to the cooking zone, while the remaining amount, approximately 20%-25% was added to the countercurrent zone. The concentration of alkali could in this way be reduced to a level of approximately 40 g NaOH/l at the commencement of the impregnation. A certain evening out of the alkali profile during the cooking stage could in this way be achieved.

A total charge of alkali added to the cooking stage can typically be equivalent to 18% effective alkali, calculated as NaOH, in a digester using the MCC technology. Of this, 12% is added to the impregnation (the relative fraction then is $^{12}/_{18}*100\approx67\%$ of the total charge), while 2% (relative fraction $^{2}/_{18}*100\approx11\%$ of the total charge) is added to the transfer line, and 4% (equivalent to a relative fraction of $^{4}/_{18}*100\approx22\%$ of the total charge) to the second countercurrent zone during the cooking stage.

The use of very high fluid/wood ratios has been introduced, as has the use of a high fraction of black liquor in the pre-impregnation vessel, in order to further even out the alkali profile during the cooking stage. This technology constitutes one of the basic principles of the COMPACT COOKING™ concept developed by Kvaemer Pulping. The alkali concentration in the cooking fluid can in this way be reduced, while a great deal of alkali is at the same time available in the impregnation fluid and in the cooking fluid during the initial and rapid neutralisation process. The amount of alkali required for an efficient neutralising process can then be present in the cooking fluid. Fluid/wood ratios as high as 7:1 and up to 8:1 have been applied in the preimpregnation vessels in these systems and in digesters with an integrated impregnation zone.

Various suggestions for the adjustment of alkali during the cooking stage in the digester have been used with the purpose of evening out the alkali profile. For example, adjustment circuits can be used, in which an amount of cooking fluid is withdrawn from the digester and subsequently returned to the digester following adjustment of the alkali, or in which the cooking fluid that is withdrawn and subsequently returned to the digester is fully or partially replaced by solvent, a procedure that principally gives a reduction in the dissolved material (lignin, etc.). Withdrawal of the cooking fluid at several positions and the subsequent replacement of the withdrawn cooking fluid by another fluid, however, results in a reduced yield, since residual fibres and dissolved hemicellulose disappear with the cooking fluid that is withdrawn.

One method of increasing the yield has been to add polysulphide during the cooking stage, although the polysulphide is liable to thermal degradation, something that leads to a large amount being degraded by the high cooking temperature before any influence to increase the yield of the pulp is achieved.

A further method involves the return of cooking fluid that has been withdrawn from the initial phase of the cooking stage, such cooking fluid being rich in dissolved xylan, and the subsequent return of the xylan-rich fluid to the final phase of the cooking stage, where the xylan can be re-precipitated onto the fibres. This process depends on the xylan-rich liquor being retained for a long period, typically at least 60 minutes, such that the precipitation process has sufficient time to commence and to give a noticeable influence on the increase in yield. The yield can typically be increased by 2%-5% using this type of xylan re-precipitation.

The yield is highly significant during cooking since an increase of only 1% means that a production facility of normal size, having an output of 1,500 tonnes a day, would experience an increase in production of 15 tonnes, which, with a pulp price of 700 USD/ADT, gives an increased income of at least 10,500 USD a day. Increase of marginal production results in essentially pure profit.

Furthermore, the load on the recovery system is reduced if a smaller fraction of the cellulose is sent to evaporation and combustion in the soda recovery furnace.

Several different solutions are known in which black liquor is used as impregnation fluid in an impregnation zone before the cooking stage. A system is revealed by U.S. Pat. No. 5,080,755 with black liquor in the inlet. A variation is revealed by U.S. Pat. No. 5,053,108 in which black liquor withdrawn from the digester is recirculated to the high-pressure tap in order there to form the major part of the treatment fluid in the transfer circulation to the digester. EP 477,059 reveals a variant that has been developed further, in which wood chips impregnated with black liquor are raised to cooking temperature before the principal addition of the white liquor. These show that numerous suggestions for processes have been studied with the purpose of improving the quality of the pulp and the yield while maintaining a high degree of delignification in the pulp that is washed after the cooking stage.

AIM AND PURPOSE OF THE INVENTION

The principal purpose of the invention is to increase the yield from the cooking stage by using a sequence of treatment fluids in which the most advantageous conditions possible for the pulp are established during the transfer, the impregnation and the subsequent cooking.

A second purpose is to exploit during the use of primarily polysulphide-rich white liquor the effect of polysulphide in raising the yield at a process position at which the temperature is not extremely high and at which the polysulphide can provide its yield-increasing effect, without giving the polysulphide sufficient time to be degraded. A subsequent increase in temperature of the chips can then take place in another impregnation fluid and cooking fluid, after which the cooking stage can properly take place. The polysulphide reacts more rapidly than alkali, in particular at low temperatures, and essentially only a minor fraction of the alkali that is subsequently used in the cooking stage is consumed. The oxidising ability of the polysulphide, i.e. the yield-increasing effect, increases as the level of alkali increases. This means that it is also advantageous to add polysulphide with the white liquor at an early stage of the cooking process.

A further purpose is to obtain by the early addition of the alkali-rich treatment fluid at a moderate temperature and for a short retention time an efficient initial neutralisation of the chips and the dissolving of readily soluble lignin without the strength of the pulp being significantly influenced. The longer impregnation processes and the final cooking process can, by the use of the method, take place at a lower level of alkali, which gives an overall high pulp strength and high yield.

The invention can be used on both steam-phase digesters and on hydraulic digesters; with inverted top separators, with downward-feeding top separators and with types that lack a top separator; and it can be used during the production of cellulose pulp using both the sulphite process and the sulphate process. In the same way, deciduous wood, coniferous wood, annuals (such as bagasse, etc.) and others can constitute the source of cellulose.

The invention can be used with chargewise cooking, in which the chips are fed into a vessel in which sequential treatment subsequently takes place on the stationary chips in the vessel.

DETAILED DESCRIPTION OF PREFERRED EMBODIMENTS

Figure 1:
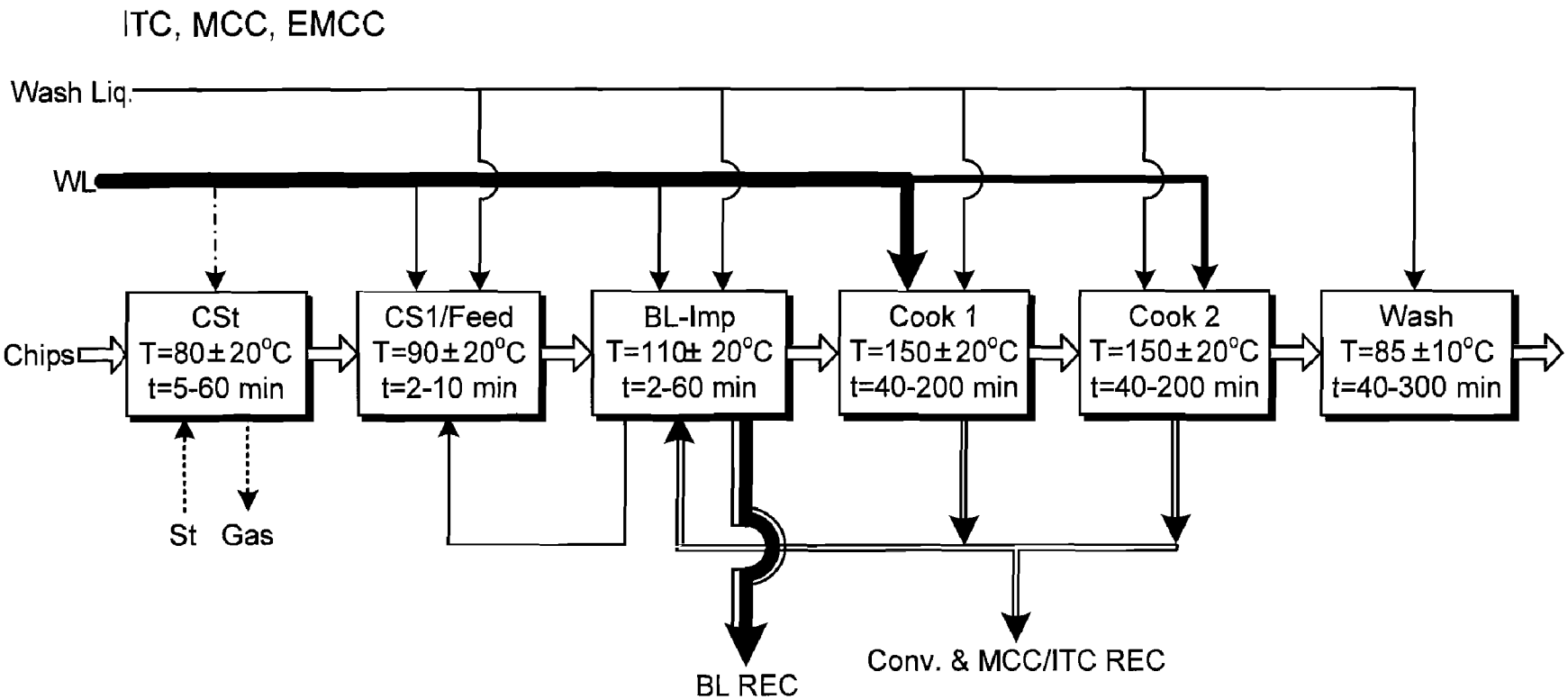
FIG. 1 PRIOR ART
FIG. 1 shows how the addition of white liquor is carried out according to the prior art.

FIG. 1 shows an overview of how cellulose pulp has been conventionally manufactured with various basic cooking processes. The starting material, often chipped wood, is fed into a chip hopper in which heating of the chips by steam takes place (CSt/Chip Steaming). This often occurs in several stages with steam (St/Steam) of successively increasing heat value (temperature) being used. The starting material is heated to the interval 80±20° C., during a period of at least 5-60 minutes. Normally, toxic waste gases (Gas) are formed, which must be handled and destroyed in a waste gas system. After being heated by steam, the cellulose material is mixed or forms a sludge as a fluid/wood mixture through the addition of fluid. The fluid that is added is obtained from a subsequent treatment in the cooking stage, and is known as black liquor (BL/Black Liquor), and often with the addition of white liquor/alkali (WL/White Liquor). This fluid/wood mixture is introduced into a transfer circulation system, which often includes a pump or several pumps and sluice feeds (for example, a high-pressure tap), onwards to a pressurised treatment vessel. Here, one treatment stage, BL-imp/Black Liquor Impregnation, is shown, in which the cellulose material is impregnated with black liquor having a predetermined level of residual alkali. In association with the input feed to this treatment stage, the major fraction of the fluid is separated in the transfer circulation system and returned to the input, Csl/Feed, while new fluid in the form of black liquor and washing fluid, Wash Liq, is added.

Once the cellulose material has been treated with black liquor and has consumed the residual alkali in it, the remaining expended black liquor is withdrawn for recovery, BL-REC. The residual alkali level normally lies significantly under 15 g/l, typically under 8 g/l.

After the impregnation, which can occur in more than one stage with different black liquors, the cooking itself is started. Two cooking stages are shown here, Cook1 and Cook2, where the first cooking stage Cook1 can be what is known as a concurrent cooking stage, conventionally at temperatures in the interval 150±20° C., where the alkali is added at the start of the cooking stage and is allowed to accompany the chips in a continuous digester.

In older cooking systems, expended cooking fluid, black liquor, was withdrawn from the cooking stage for recovery, Conv. & Mcc/ITC REC, and in this case no black liquor was returned to a previous black liquor impregnation stage. The cooking in the second cooking stage Cook2 can take place using a design with countercurrent flow, conventionally at a temperature in the interval 150±20° C. A certain amount of the alkali can at this stage be added at the bottom of the countercurrent flow zone, after which the cooking fluid passes in a flow that courses counter to the flow of the chips.

The chips normally have a retention time in the cooking zones Cook1/Cook2 that lies in the interval 40-200 minutes.

Washing, also known as displacement, commences after the cooking stage, where dissolved lignin is washed from the cooked pulp in order to obtain a pulp with a value of kappa under 40, preferably a value of kappa under 24. With respect to the addition of white liquor, WL, this was carried out principally at the beginning of the cooking stage, and only very small charges, well under 50% and usually under 20%, of white liquor were added at the impregnation stage before the cooking stage. When polysulphide-rich white liquor was used to increase the yield, this was added during impregnation, at lower temperature, and was allowed to accompany the chips to the cooking stage. The cooking stage was modified when black liquor impregnation was introduced such that a relatively high level of residual alkali, normally around 20 g/l or higher, was obtained in the black liquor withdrawn from the digester, which black liquor was conveyed to the black liquor impregnation where the residual alkali was consumed down to a level that lay under 10 g/l, while the main fraction, greater than 50%, of the total charge of white liquor, WL, that was necessary for the process was still carried out at the cooking stage.

Figure 2:
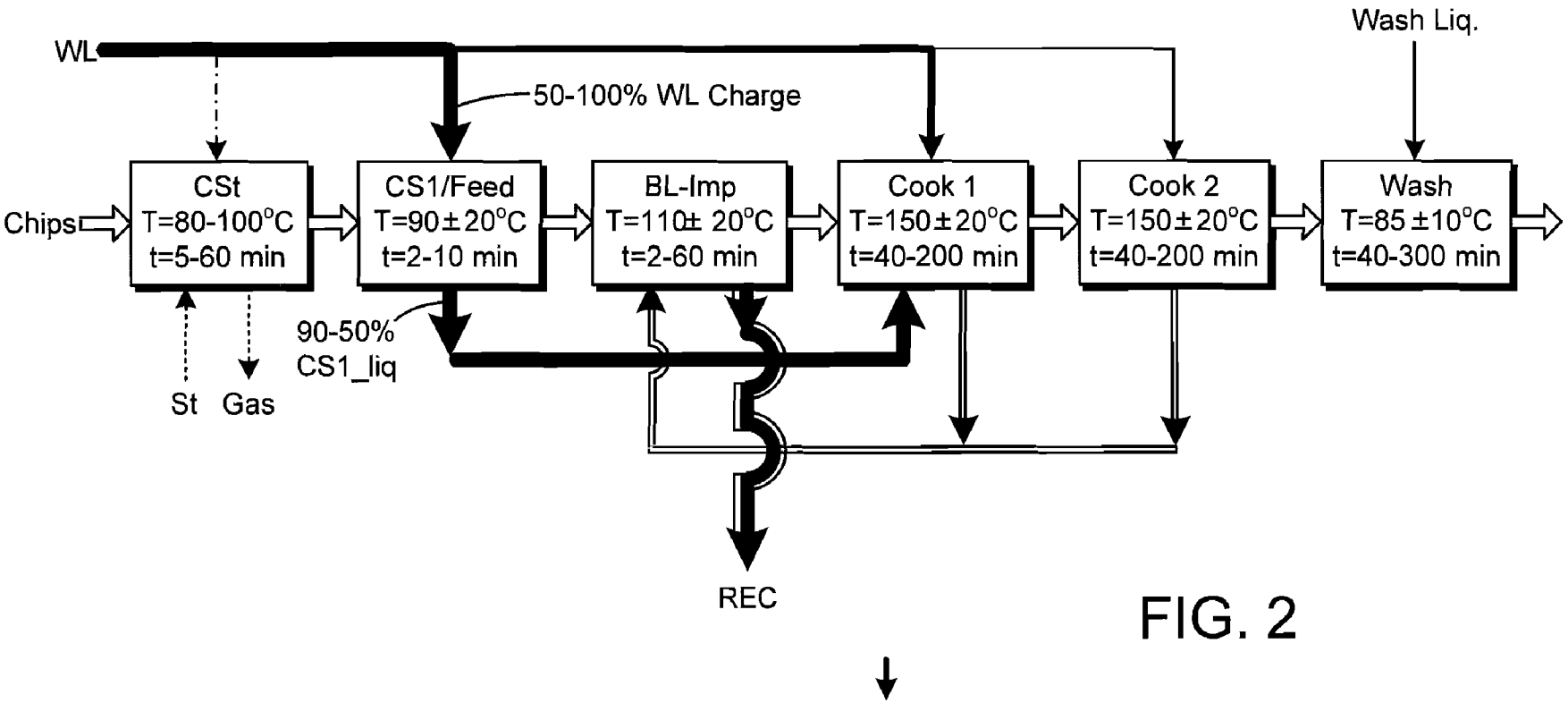
FIG. 2 shows how the addition of white liquor is carried out according to the invention.

A preferred embodiment according to the invention is shown in FIG. 2, where the main part, more than 50%, of the total charge of the white liquor instead occurs at a pretreatment stage that is located before the stage at which treatment with black liquor occurs.

The starting material (chips) is fed as previously shown to at least one stage at which heating of the chips by means of steam (CSt) occurs. The heating of the starting material preferably takes place at a temperature in the interval 80±20° C., during a period of at least 5-60 minutes.

After the heating with steam, the cellulose material is mixed or forms a slurry as a fluid/wood mixture by the addition of fluid (which has been obtained from a subsequent treatment stage in the cooking stage) and a major part of the total charge of fresh white liquor required for the cooking stage. At least 50% of the total charge of alkali that is required to cook the cellulose down to a kappa value lower than 40, preferably a value lower than 24, is added at this stage. As much as up to 100% of the total charge of fresh white liquor for the impregnation and the cooking stage can be added at this point.

This fluid/wood mixture with a high level of alkali is carried in a transfer circulation system in a conventional manner to a pressurised treatment vessel. One treatment stage, BL-imp/Black Liquor Impregnation, is shown here, in which the cellulose material is impregnated with black liquor having a predetermined level of residual alkali.

In association with the input feed to this treatment stage, BL-imp, the major fraction, at least 50% but up to 90%, of the fluid is separated in the transfer circulation system, after which this fluid is added to the cellulose pulp in association with the cooking stage at the cooking temperature. The possibility arises in this way for the white liquor to precipitate its content of polysulphide onto the cellulose fibres at a process position, in this case during the transfer, where the temperature is lower, which temperature is not sufficiently high for the polysulphide to risk degradation to any major extent before the yield-increasing effect arises.

The alkali-rich fluid is replaced before the treatment with black liquor by black liquor.

Once the cellulose material has been treated with black liquor and has consumed the residual alkali in it, the remaining expended black liquor is withdrawn for recovery, BL-REC. Again in this case, the residual alkali level should normally lie significantly under 15 g/l, typically under 8 g/l.

After the impregnation, which can occur in more than one stage with different black liquors, the cooking itself is started. Two cooking stages are shown here, Cook1 and Cook2, where the first cooking stage Cook1 can be what is known as a concurrent cooking stage, conventionally at temperatures in the interval 150±20° C. When the alkali-rich fluid from the transfer circulation system has been added to the cooking stage, the charge to the cooking stage of fresh alkali is reduced to the equivalent degree.

The alkali-rich fluid from the transfer circulation system and the small amount of fresh alkali that is added at the start of he cooking stage are allowed to accompany the chips in a continuous digester.

The cooking in the second cooking stage Cook2 can take place using a design with countercurrent flow, conventionally at a temperature in the interval 150±° C. A certain amount of the alkali or the alkali-rich withdrawal from the impregnation stage can at this stage be added at the bottom of the countercurrent zone, after which the cooking fluid passes in a flow opposite to that of the chips. The chips normally have a retention time in the cooking zones Cook1/Cook2 that lies in the interval 40-240 minutes, and preferably approximately 120±20° minutes per cooking zone.

Washing, also known as displacement, commences in a conventional way after the cooking stage, where dissolved lignin is washed from the cooked pulp in order to obtain a pulp with a value of kappa under 40, principally for coniferous wood, and preferably a value of kappa under 24, principally for deciduous wood.

Figure 3:
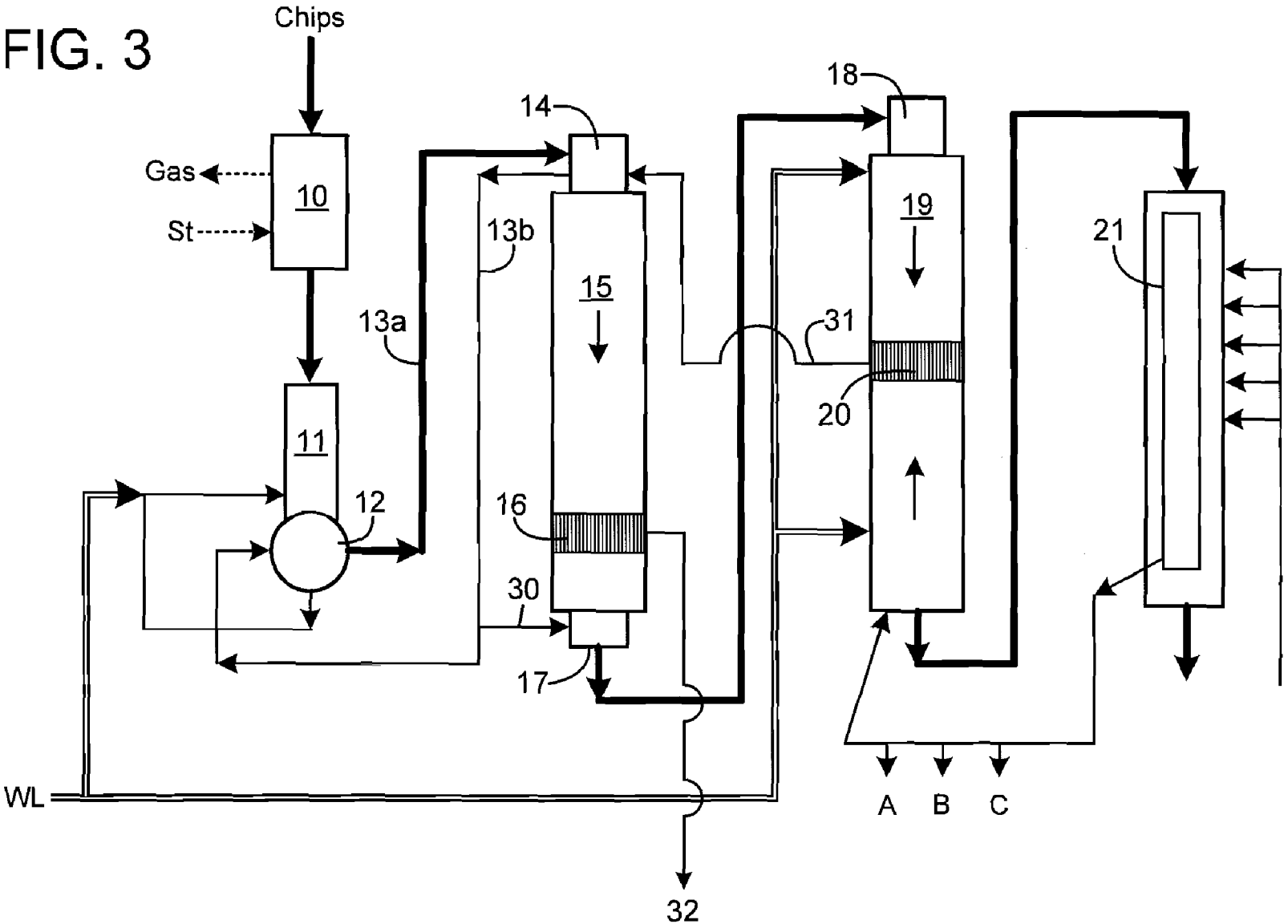
FIG. 3 shows the principle of application of the invention in a system with continuous cooking.

A system for the continuous cooking of cellulose pulp where the method according to the invention can be applied is shown in FIG. 3. Chips are fed into a chip hopper 10 where the chips are heated by steam, St, with the expulsion of waste gases, Gas. The chips heated in this way are then fed to a chip chute 11 where a slurry with an appropriate fluid/wood ratio is formed from the chips by the addition of white liquor, WL, possibly together with the addition off black liquor (not shown in the drawing). The chips pass onwards from the bottom of the chip chute 11 by a high-pressure tap 12 through a transfer circulation system 13*a*, 13*b* to a pressurised treatment vessel 15 for black liquor impregnation. The fluid that is added to the chip chute 11 and that accompanies the chips in the line 13*a* is separated to a large extent from the chips by a top separator 14 and is returned to the high-pressure tap 12 through the return line 13*b*. The alkali-rich transfer fluid is withdrawn in a flow 30 to an extent that is equivalent to the addition of fresh white liquor at the chip chute 11 for later addition before the cooking stage.

The addition of white liquor at this position in the system ensures a relatively short retention time is obtained at a moderate temperature, in the interval 60±40° C. for approximately 2-60 minutes, preferably 2-10 minutes, which is the reason that the high level of alkali does not have sufficient time to influence the strength of the pulp.

An impregnation with black liquor that has been added through the line 31 and that has been withdrawn from the cooking stage through the withdrawal filter 20 takes place in the treatment vessel 15. The residual alkali level in the black liquor in the line 31 normally lies considerably over 15 g/l.

Consumption of the residual alkali takes place in the treatment vessel 15 and expended black liquor with a residual alkali level less than 10 g/l is withdrawn from the filter 16 for onwards transport to the recovery system 32.

The chips are fed to the digester 19 after treatment with black liquor in the vessel 15 and it is appropriate that the alkali-rich fluid 30 is added to the chips before the cooking stage in association with the output 17 from the treatment vessel 15. The starting material that has been pre-treated in this way is continuously fed to the top of the digester 19. After cooking in, for example, a first concurrent cooking stage and a final countercurrent cooking stage, the cooked pulp is fed out from the bottom of the digester and onwards to washing equipment 21, in this case a pressurised-air diffuser, where the lignin that has been dissolved in the cooking phase is washed out in order to obtain cellulose pulp with a kappa value under 40, preferably with a kappa value under 24.

Only those functions relevant to the invention are shown in FIG. 3. There may, for example, be several warming circuits or several withdrawal positions both in the impregnation vessel 15 and in the digester 19. In the same way, several washing fluids or solvents can be withdrawn at A, B or C in order to be added to the inlet, the impregnation or the cooking phase, in order to establish the correct fluid/wood ratios in these zones.

If a chargewise cooking system is used for the manufacture of cellulose pulp, the alkali-rich treatment according to the invention can be placed before or after the impregnation with warm black liquor, where the chargewise cooking of the chips with which the vessel has been filled takes place according to the sequence:

1) Filling of the vessel with chips.
2) Heating of the chips with steam.
3) Heating/impregnation with warm black liquor.
4) Heating/impregnation with hot black liquor.
5) Cooking with cooking liquor.
6) Washing with compression after the cooking stage, with the expelled cooking fluid being stored in a tank for hot black liquor.
7) Washing with compression after the previous stage with washing fluid, where the fluid expelled first is stored in a tank for warm black liquor.
8) Emptying of the cooked and washed chips.

The alkali-rich treatment can thus be placed before step 3 or after step 3 in the sequence specified above, as an additional step or a step that replaces step 3 in which the chips are treated with the fresh white liquor.

The invention can be modified in several ways within the framework of the claims.

For example, the invention can also be used in a continuous digester in an upper treatment zone at an impregnation stage, which zone is limited by a withdrawal filter in an upper part for treatment with alkali-rich treatment fluid, and at least one treatment zone for black liquor that is located beneath it.

The alkali-rich fluid that has been withdrawn from the slurried cellulose suspension before the black liquor impregnation stage can also be added at several positions in the cooking phase. For example, at least a part of the alkali-rich treatment fluid can be added at the bottom of the digester at the end of a countercurrent zone. It can also be added in the middle of the cooking phase if all cooking zones in the digester are concurrent zones.

The invention is most advantageous in pulp mills in which polysulphide-rich white liquor is produced for use in the cooking process, which polysulphide gives a significant increase in yield from the cooking stage if it can be used in an optimal manner without being degraded before its beneficial effects on the fibres are obtained. The polysulphide reacts much more rapidly than the alkali, which is why full effect of the polysulphide is obtained without any major consumption of alkali.

The invention claimed is:

1. A method for the manufacture of cellulose pulp, in which wood chips are treated in several stages including at least one cooking stage, comprising:

warming the wood chips with steam to a first temperature;

prior to feeding the steamed wood chips to a treatment stage, adding an alkali rich impregnation fluid to the steamed wood chips in a pre-treatment stage, the pre-treatment stage being prior to and upstream of the treatment stage, the added alkali rich impregnation fluid constituting at least 50% of a total charge of fresh alkali required to cook cellulose pulp;

the alkali rich impregnation fluid and the alkali treated wood chips forming a slurry in the pretreatment stage;

feeding the slurry to the treatment stage;

prior to impregnating the wood chips with a black liquor in the treatment stage, the black liquor being withdrawn from a cooking stage, separating a main portion of the alkali rich impregnation fluid from the alkali treated wood chips;

replacing the separated alkali rich impregnation fluid with the black liquor withdrawn from the cooking stage;

prior to the cooking stage, impregnating the wood chips with the black liquor withdrawn from the cooking stage and impregnating the wood chips with the black liquor in the treatment stage, the black liquor withdrawn from the cooking stage having a temperature being at least 20° C. below a cooking temperature of between 130-170° C.;

withdrawing the black liquor from the treatment stage;

after the withdrawal of the black liquor from the treatment stage, adding back the separated alkali rich impregnation fluid to the black liquor impregnated wood chips disposed in the treatment stage;

conveying the black liquor impregnated wood chips and the separated alkali rich impregnation fluid to the cooking stage;

withdrawing black liquor from the cooking stage and conveying the black liquor withdrawn from the cooking stage to a beginning of the treatment stage to replace the separated alkali rich impregnation fluid; and cooking the wood chips at the cooking temperature to form cellulose pulp.

2. The method according to claim 1, wherein the method further comprises providing the impregnation fluid in the pre-treatment stage by at least 50% of the total charge of fresh alkali required to impregnate and cooking the cellulose pulp down to a kappa value that lies under 40.

3. The method according to claim 1 wherein the method further comprises providing the impregnation fluid in the pre-treatment stage by up to 100% of the total charge of fresh alkali required to impregnate and cooking the cellulose pulp down to a kappa value that lies under 40.

4. The method according to claim 1, wherein the method further comprises setting the first temperature to a temperature being in a temperature interval of 60 °±40° C.

5. The method according to claim 4, wherein the method further comprises setting a retention time in the pre-treatment stage within an interval of 2-60 minutes.

6. The method according to claim 5, wherein the method further comprises providing the withdrawn impregnation fluid with a residual alkali level greater than 35 g/l.

7. The method according to claim 6, wherein the method further comprises transferring the impregnation fluid withdrawn from an extra stage to a position in a subsequent cooking stage with full cooking temperature.

8. The method according to claim 5, wherein the method further comprises heating the wood chips by means of steam before the pretreatment stage to a temperature in an interval of 60-100° C.

9. The method according to claim 1 wherein the method further comprises applying the method in a continuous process with a continuous digester where the wood chips are fed continuously to a top of the digester and where cellulose pulp is continuously fed out from a bottom of the digester.

10. The method according to claim 9, wherein the method further comprises associating the pre-treatment stage with the transfer of the wood chips from a chip hopper through a transfer circulation system to a pressurised treatment vessel in which treatment of the wood chips takes place with black liquor with a given level of residual alkali.

11. The method according to claim 10, wherein the method further comprises obtaining the black liquor with a given level of residual alkali by withdrawal from the cooking stage, where the black liquor has a level of residual alkali in an interval of 10-100 g/l.

12. The method according to claim 1 wherein the method further comprises applying the method in a charge-wise process in which the wood chips are fed to a vessel and in which different treatment fluids are thereafter used in a sequence in order to permeate the wood chips in the vessel until the wood chips has been cooked to a predetermined kappa value.

* * * * *